US010415342B2

(12) United States Patent
Solhaug et al.

(10) Patent No.: US 10,415,342 B2
(45) Date of Patent: Sep. 17, 2019

(54) HIGH FLOW AREA SWELLABLE CEMENTING PACKER

(71) Applicant: HALLIBURTON ENERGY SERVICES, INC., Houston, TX (US)

(72) Inventors: Kristian Solhaug, Stavanger (NO); Terje Abrahamsen, Stavanger (NO); Kristian Andersen, Stavanger (NO); Rune Hobberstad, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 14/382,670

(22) PCT Filed: Feb. 6, 2013

(86) PCT No.: PCT/US2013/024888
§ 371 (c)(1),
(2) Date: Sep. 3, 2014

(87) PCT Pub. No.: WO2014/123520
PCT Pub. Date: Aug. 14, 2014

(65) Prior Publication Data

US 2015/0167419 A1 Jun. 18, 2015

(51) Int. Cl.
*E21B 33/12* (2006.01)
*E21B 33/13* (2006.01)
(Continued)

(52) U.S. Cl.
CPC ..... *E21B 33/1208* (2013.01); *E21B 23/06* (2013.01); *E21B 33/13* (2013.01); *E21B 33/16* (2013.01)

(58) Field of Classification Search
CPC ..... E21B 33/1208; E21B 33/16; E21B 23/06; E21B 33/13; E21B 17/1014
See application file for complete search history.

(56) References Cited

U.S. PATENT DOCUMENTS 2,620,035 A * 12/1952 Clark ..... E21B 27/00 166/102
3,385,367 A * 5/1968 Kollsman ..... E21B 33/1208 166/191
(Continued)

FOREIGN PATENT DOCUMENTS

AU 2010214801 A1 3/2012
CA 2739423 A1 4/2010
(Continued)

OTHER PUBLICATIONS

Extended European Search Report for Application No. 13874556.7-1601/2904191 PCT/US2013024888 dated May 24, 2016.
(Continued)

*Primary Examiner* — William D Hutton, Jr.
*Assistant Examiner* — Steven A MacDonald
(74) *Attorney, Agent, or Firm* — Locke Lord LLP

(57) ABSTRACT

A well packer can include a seal element adapted to extend continuously about a tubular, the seal element including a swellable material, and multiple longitudinally extending cement flow channels formed on an exterior of the seal element. A method of constructing a well packer for use in cementing a tubular in a wellbore can include forming a seal element having multiple longitudinally extending cement flow channels on an exterior thereof, the seal element including a swellable material, and positioning the seal element on the tubular, the seal element extending continuously about the tubular. A method of cementing a tubular in a wellbore can include flowing cement through an annulus between the tubular string and the wellbore, the flowing including flowing the cement through multiple longitudinally extending cement flow channels on a seal element which continuously encircles the tubular, and swelling a swellable material of the seal element.

12 Claims, 5 Drawing Sheets

(51) Int. Cl.
*E21B 23/06* (2006.01)
*E21B 33/16* (2006.01)

(56) References Cited

U.S. PATENT DOCUMENTS

| | | | | |
|---|---|---|---|---|
| 3,887,006 | A * | 6/1975 | Pitts | E21B 23/06 166/124 |
| 4,919,989 | A * | 4/1990 | Colangelo | E21B 33/14 166/180 |
| 5,908,072 | A * | 6/1999 | Hawkins | E21B 17/1064 166/241.1 |
| 7,422,071 | B2 * | 9/2008 | Wilkie | E21B 33/1208 166/179 |
| 7,441,606 | B2 | 10/2008 | Maguire | |
| 7,690,437 | B2 * | 4/2010 | Guillot | E21B 33/1208 166/177.2 |
| 7,721,799 | B2 | 5/2010 | Baski | |
| 7,757,758 | B2 * | 7/2010 | O'Malley | E21B 17/1078 166/206 |
| 7,841,417 | B2 | 11/2010 | Allison et al. | |
| 8,127,859 | B2 * | 3/2012 | Allison | E21B 33/1208 166/285 |
| 2002/0023749 | A1 * | 2/2002 | Kirk | E21B 17/1042 166/241.1 |
| 2003/0010540 | A1 * | 1/2003 | Kirk | E21B 17/1042 175/325.5 |
| 2008/0066900 | A1 | 3/2008 | Saebi et al. | |
| 2008/0078561 | A1 * | 4/2008 | Chalker | E21B 33/1208 166/387 |
| 2008/0121390 | A1 * | 5/2008 | O'Malley | E21B 43/108 166/207 |
| 2009/0000793 | A1 * | 1/2009 | Guillot | E21B 33/1208 166/380 |
| 2009/0272525 | A1 * | 11/2009 | Nutley | E21B 17/10 166/241.6 |
| 2010/0032158 | A1 | 2/2010 | Dale et al. | |
| 2010/0126735 | A1 * | 5/2010 | Allison | E21B 33/1208 166/387 |
| 2011/0030954 | A1 * | 2/2011 | Allison | E21B 33/1208 166/285 |
| 2011/0042096 | A1 * | 2/2011 | Nutley | E21B 43/08 166/369 |
| 2011/0079390 | A1 | 4/2011 | Themig | |
| 2012/0145412 | A1 | 6/2012 | Andersen et al. | |
| 2013/0146312 | A1 * | 6/2013 | Gerrard | C09K 8/44 166/387 |

FOREIGN PATENT DOCUMENTS

| | | | |
|---|---|---|---|
| CN | 202645525 | U | 1/2013 |
| EP | 1793078 | A1 | 6/2007 |
| EP | 1793087 | A1 | 6/2007 |
| WO | 9710412 | A1 | 3/1997 |

OTHER PUBLICATIONS

Fei Yin, et al.; "Design of Self Swellable Casing Centralizer for Zonal Isolation in Petroleum Wells", Advanced Materials Research vols. 524-527, pp. 1372-1377, dated May 14, 2012, 7 pages.

Weatherford; "Micro-Seal Isolation System-Bow (MSIS-B)", Swellable Well Construction Products, article No. 7291.02 dated 2009-2011, 2 pages.

Weatherford; "Swellable Product Range", Well Construction Products Sales Seminar, dated 2010, 38 pages.

International Search Report with Written Opinion dated Oct. 18, 2013 for PCT Patent Application No. PCT/US2013/024888, 12 pages.

Fei Yin, et al.; "Design of Self Swellable Casing Centralizer for Zonal Isolation in Petroleum Wells—A Utility Model of Well Completion Tool", Advanced Materials Research vols. 524-527 (2012) pp. 1372-1377, dated May 14, 2012, 7 pages.

Weatherford; "Swellable Well Construction Systems", company drilling products via http://www.weatherford.com/products/drilling/swellablewellconstructionsystems, dated Jun. 25, 2012, 2 pages.

Weatherford; "Micro-Seal Isolation System-Bow (MSIS-B)", Swellable Well Construction Products article 7291.02, dated 2009-2011, 2 pages.

GCC Examination Report dated Nov. 12, 2018, issued during the prosecution of corresponding GC Patent Application No. GC 2014-26371.

* cited by examiner

HIGH FLOW AREA SWELLABLE CEMENTING PACKER

CROSS-REFERENCE TO RELATED APPLICATION

This application is a national stage under 35 USC 371 of International Application No. PCT/US13/24888, filed on 6 Feb. 2013. The entire disclosure of this prior application is incorporated herein by this reference.

TECHNICAL FIELD

This disclosure relates generally to equipment utilized and operations performed in conjunction with subterranean wells and, in at least one example described below, more particularly provides a high flow area swellable packer for use in cementing operations.

BACKGROUND

Swellable packers have been used to seal off annular spaces in wells. Cement is typically used to seal between a tubular and a wellbore or another tubular. It will be appreciated that improvements are continually needed in the arts of constructing swellable packers, and cementing tubulars in wells.

DETAILED DESCRIPTION

Figure 1:
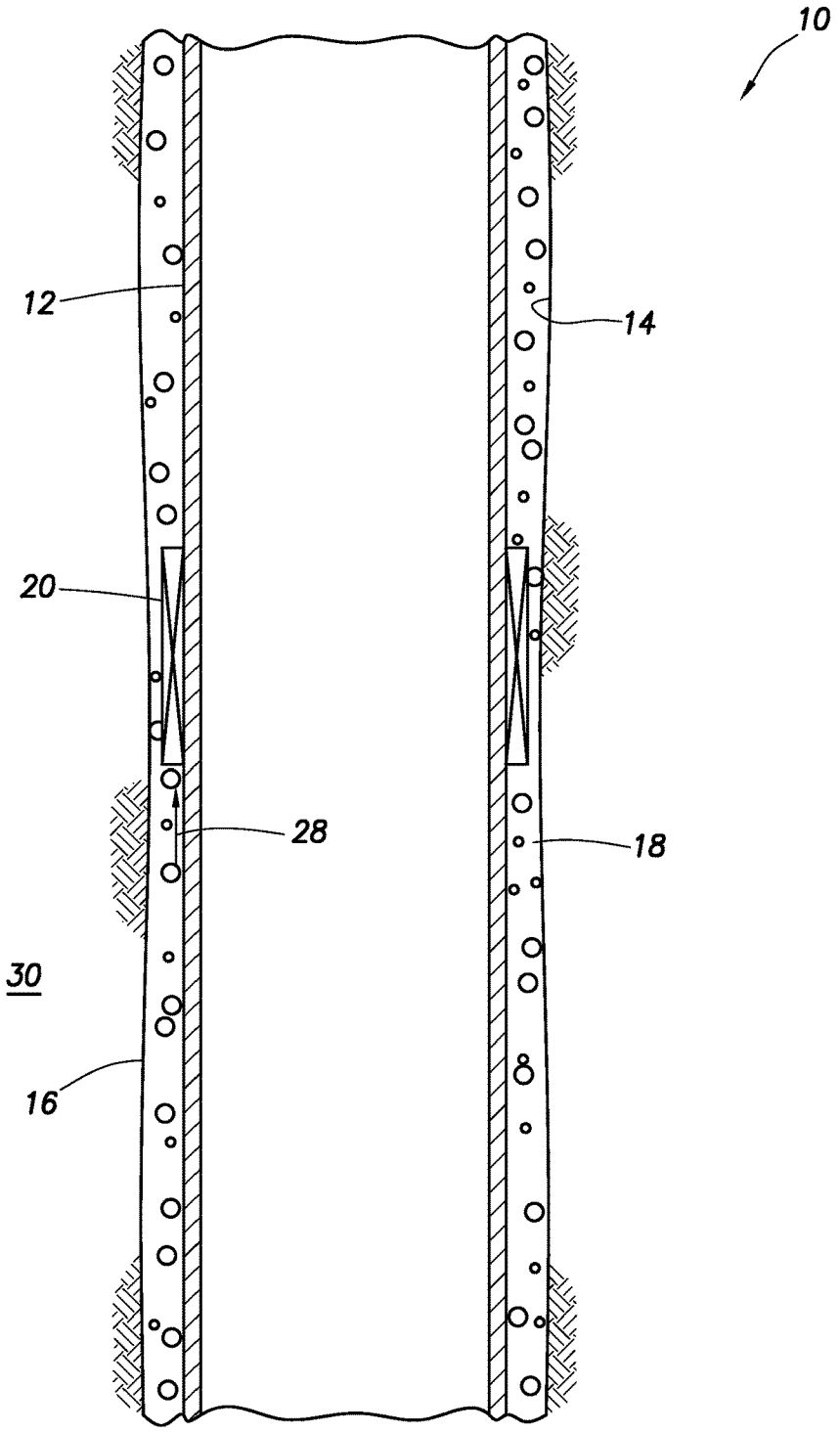
FIG. 1 is a representative partially cross-sectional view of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular 12 is cemented in a wellbore 14, with cement 16 filling an annulus 18 formed between the tubular and the wellbore. In other examples, the annulus 18 could be formed between the tubular 12 and another tubular.

As used herein, the term "tubular" is used to indicate a generally tubular element, including but not limited to such tubulars known to those skilled in the art as "casing," "liner," and "tubing." In the FIG. 1 example, the tubular 12 is used to form a protective impervious internal lining for the wellbore 14.

As used herein, the term "cement" is used to indicate a flowable and hardenable material which is used to seal off an annular space about a tubular in a well. Cement may be cementitious, and/or it may include materials such as epoxies, other polymers, etc.

In the FIG. 1 example, the cement 16 is flowed into the annulus 18, until the cement fills all or part of the annulus, as desired. The cement 16 is then allowed to harden, so that the cement seals off the annulus 18 between the tubular 12 and the wellbore 14.

A well packer 20 is carried on the tubular 12. The packer 20 can be used to seal off any small annular space which may develop between the tubular 12 and the cement 16 during or after the cement hardens.

It would be desirable for the packer 20 to provide for ease of flow of the cement 16 between opposite longitudinal sides of the packer, so that the cement flow is not unduly restricted. For this purpose, the packer 20 preferably includes multiple longitudinally receiving cement flow channels on an exterior of the packer.

Figure 2:
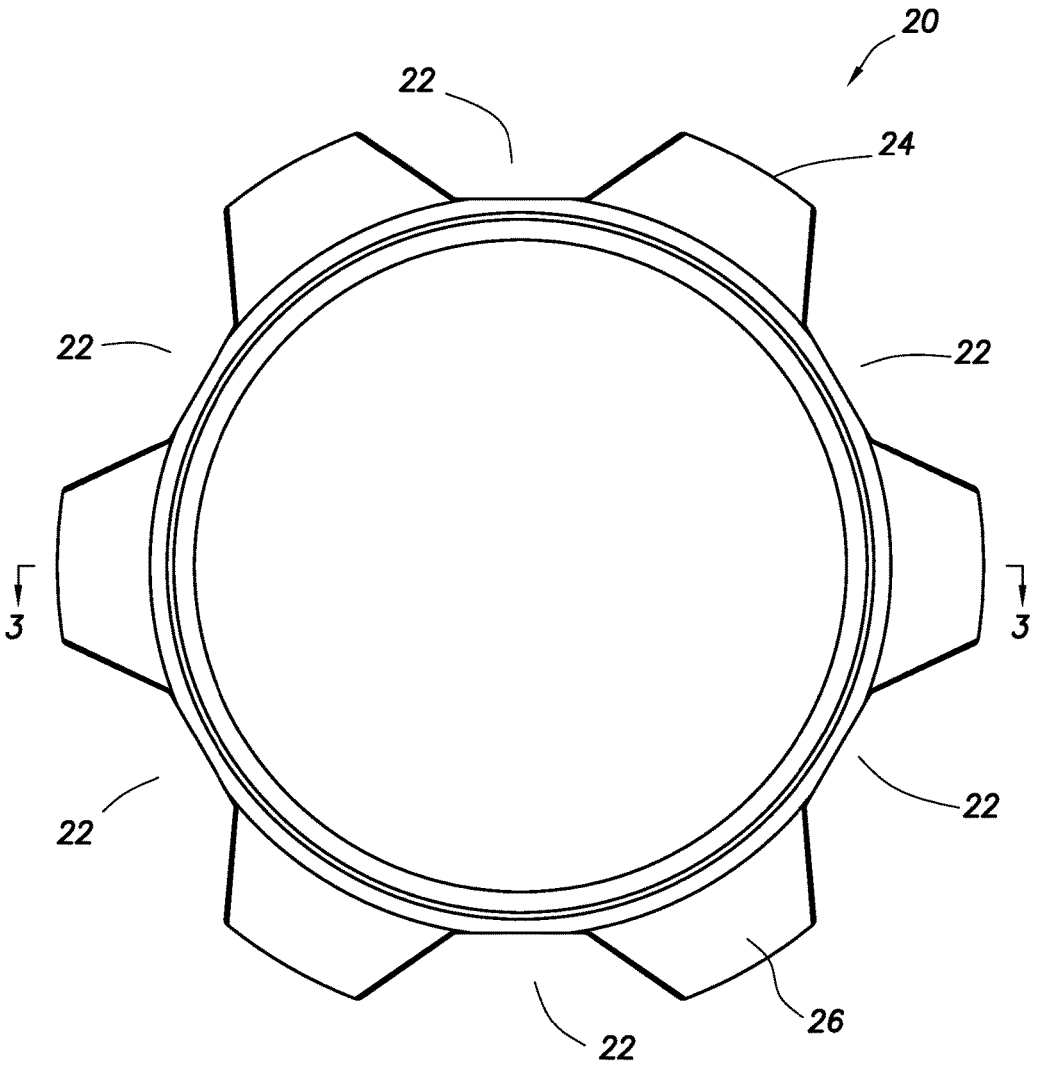
FIG. 2 is a representative end view of a well packer which may be used in the system and method of FIG. 1.

Referring additionally now to FIG. 2, an end view of one example of the packer 20 is representatively illustrated. The packer 20 may be used in the system 10 and method described above, or it may be used in other systems and methods.

The FIG. 2 example of the packer 20 includes multiple longitudinally extending cement flow channels 22 formed on an exterior of a seal element 24. The seal element 24 comprises a swellable material 26.

Preferably, the swellable material 26 swells when it is contacted with a particular activating agent (e.g., oil, gas, other hydrocarbons, water, acid, other chemicals, etc.) in the well. The activating agent may already be present in the well, or it may be introduced after installation of the packer 20 in the well, or it may be carried into the well with the packer, etc. The swellable material 26 could instead swell in response to exposure to a particular temperature, or upon passage of a period of time, or in response to another stimulus, etc.

Thus, it will be appreciated that a wide variety of different ways of swelling the swellable material 26 exist and are known to those skilled in the art. Accordingly, the scope of this disclosure is not limited to any particular manner of swelling the swellable material 26. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 26 is in this example preferably a hydrocarbon fluid (such as oil or gas). In the well system 10, the swellable material 26 swells when a fluid 28 comprises the activating agent (e.g., when the fluid enters the wellbore 14 from a formation 30 surrounding the wellbore, when the fluid is circulated to the packer 20 from the surface, when the fluid is released from a chamber carried with the packer, etc.). In response, the seal element 24 seals off the annulus 18.

The activating agent which causes swelling of the swellable material 26 could be comprised in any type of fluid. The activating agent could be naturally present in the well, or it could be conveyed with the packer 20, conveyed separately or flowed into contact with the swellable material 26 in the well when desired. Any manner of contacting the activating agent with the swellable material 26 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 26 may have a substantial portion of cavities therein which are compressed or collapsed at the surface condition. Then, after being placed in the well at a higher pressure, the material 26 is expanded by the cavities filling with fluid.

This type of apparatus and method might be used where it is desired to expand the swellable material 26 in the presence of gas rather than oil or water. A suitable swellable material is described in U.S. Published Application No. 2007-0257405, the entire disclosure of which is incorporated herein by this reference.

Preferably, the swellable material 26 used in the seal element 24 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 26 could also swell in response to contact with any of multiple activating agents. For example, the swellable material 26 could swell when contacted by hydrocarbon fluid, or when contacted by water.

Although in the FIG. 2 example, the channels 22 extend straight longitudinally along the exterior of the seal element 24, in other examples the channels may not be straight. The channels 22 could, for example, extend helically, or back and forth, etc. The scope of this disclosure is not limited to any particular shape of the channels 22.

The channels 22 allow the cement 16 to flow readily by the packer 20. By forming the channels 22 on the exterior of the seal element 24, greater flow area is provided in the annulus 18 for flow of the cement 16.

Figure 3:
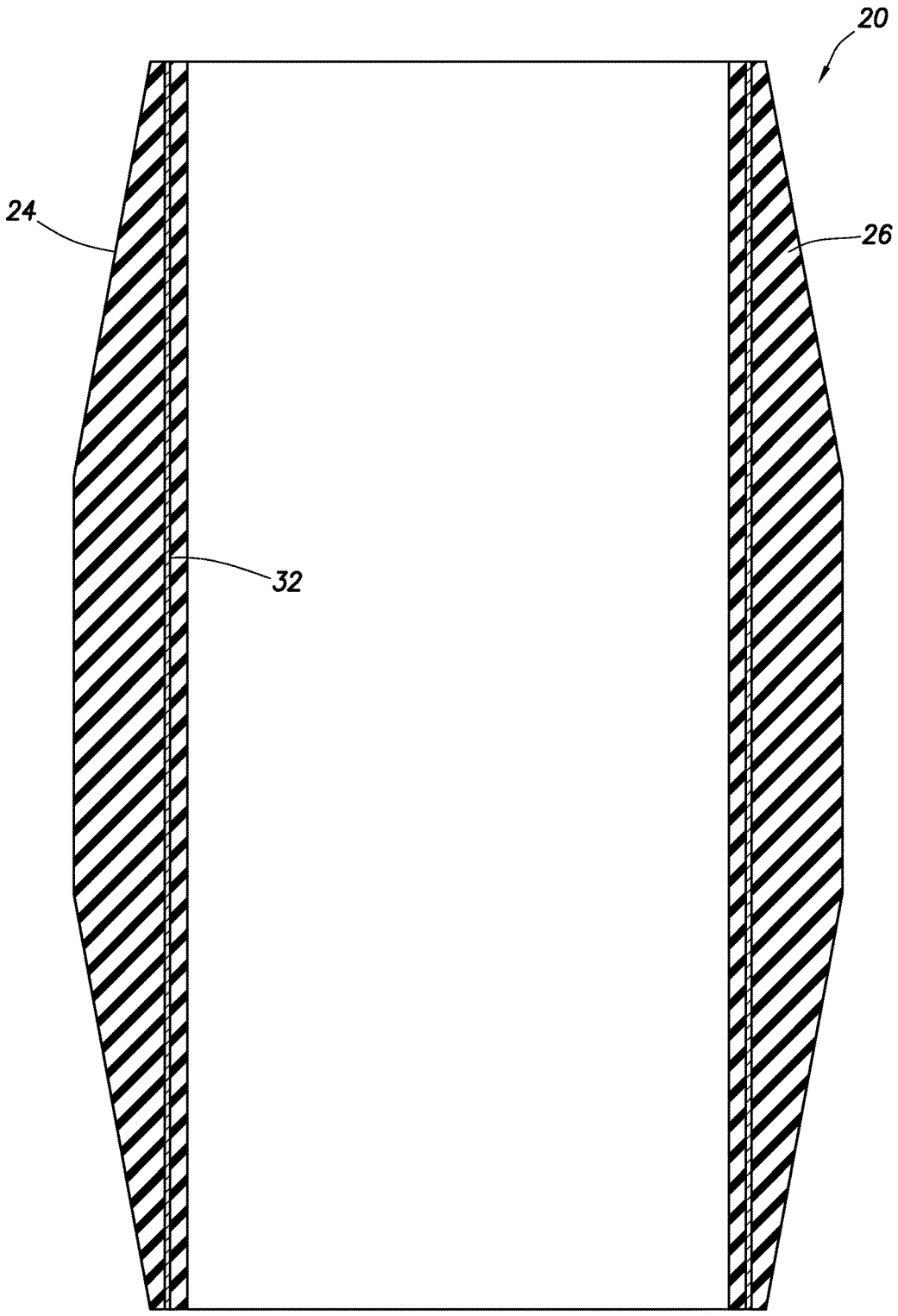
FIG. 3 is a representative cross-sectional view of the well packer.

Referring additionally now to FIG. 3, a cross-sectional view of the packer 20 is representatively illustrated. In this view, it may be seen that the seal element 24 comprises a continuous circular element that can be positioned on the tubular 12. The seal element 24 may be bonded to, molded onto, or otherwise attached to the tubular 12.

An internal reinforcement 32 may be provided in the seal element 24. In some examples, the seal element 24 may be slipped onto an exterior of the tubular 12 prior to installing the tubular in the well.

With the seal element 24 and tubular 32 positioned on the tubular 12, clamp rings or end rings may be used to prevent or at least restrict longitudinal movement of the seal element 24 relative to the tubular. Multiple seal elements 24 may be positioned longitudinally between the clamp or end rings. Thus, the scope of this disclosure is not limited to any particular number or configuration of the seal element 24 on the tubular 12, or to any particular means (if any) of securing the seal element to the tubular.

Figure 4:
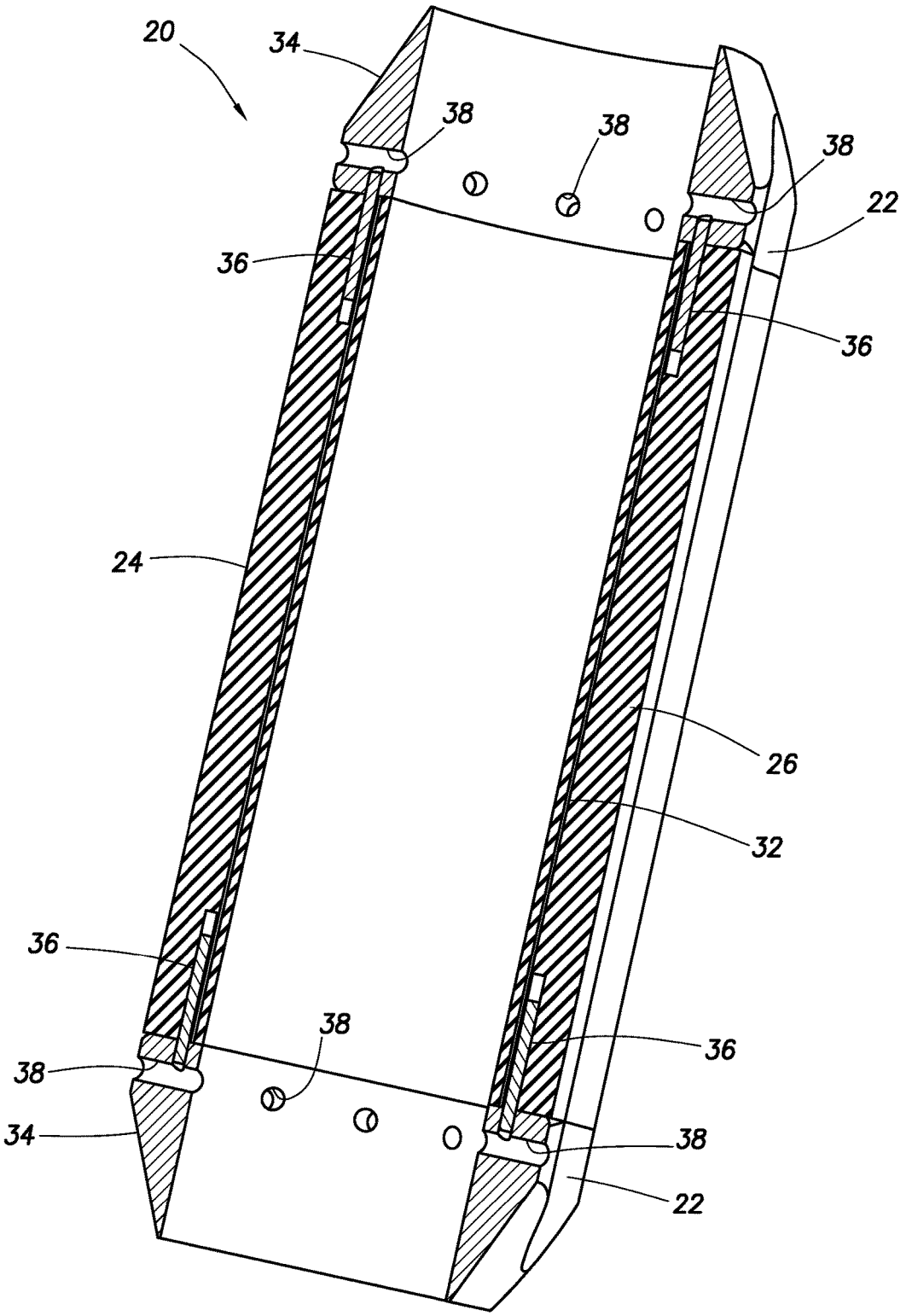
FIG. 4 is a representative perspective quarter-sectional view of another example of the well packer.

Referring additionally now to FIG. 4, another example of the packer 20 is representatively illustrated. In this example, the seal element 24 is secured against longitudinal movement relative to the tubular 12 by means of end rings 34 at opposite ends of the seal element.

Note that the end rings 34 are formed so that the channels 22 extend across an exterior of each end ring. In this manner, the end rings 34 can both restrict movement of the seal element 24, and provide for increased flow area for the cement 16 in the annulus 18.

Pins, keys or other types of alignment devices 36 may be used to rotationally align the channels 22 in the end rings 34 with the channels in the seal element 24. The end rings 34 may be secured against movement relative to the tubular 12 by means of set screws (not shown) installed through openings 38.

Figure 5:
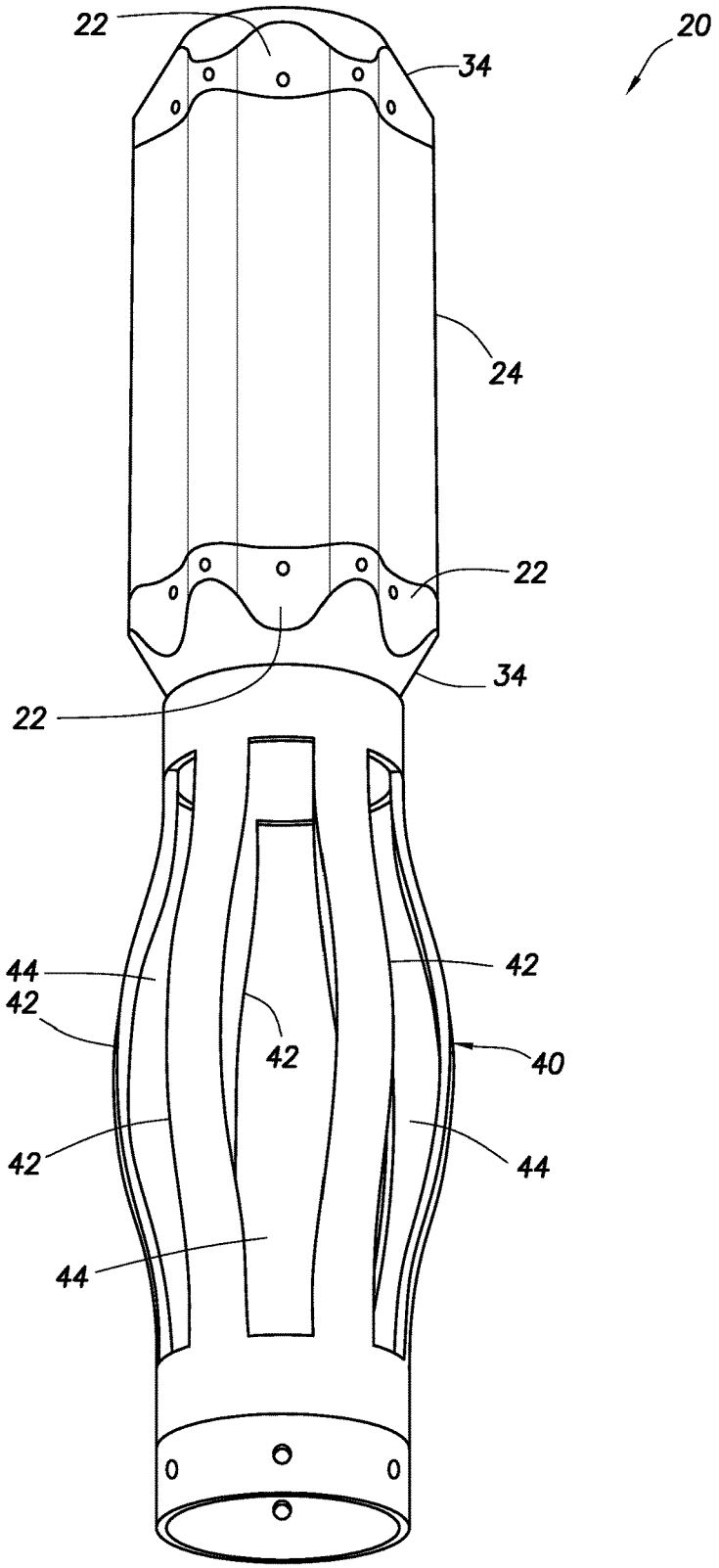
FIG. 5 is a representative side view of yet another example of the well packer.

Referring additionally now to FIG. 5, yet another example of the packer 20 is representatively illustrated. In this example, a centralizer 40 is incorporated into the packer 20.

The centralizer 40 includes multiple circumferentially spaced apart resilient arms 42 configured for contacting the wellbore 14 (or a surrounding tubular) and centralizing the tubular 12 in the wellbore. Note that spaces 44 between the arms 42 are rotationally aligned with the channels 22, so that flow of the cement 16 is not unduly impeded across the centralizer 40 and the remainder of the packer 20.

Although the arms 42 are depicted in FIG. 5 as comprising flexible leaf or beam-type arms, other types of arms and other types of centralizers may be used in keeping with the principles of this disclosure.

It may now be fully appreciated that the above disclosure provides significant advancements to the arts of constructing swellable packers and cementing tubulars in wells. The packer 20 described above can seal off an annular space between the tubular 12 and the cement 16, with restriction to flow of the cement through the annulus 18 being mitigated by the configuration of the seal element 24.

A well packer 20 is provided to the art by the above disclosure. In one example, the packer 20 can include a seal element 24 adapted to extend continuously about a tubular 12, the seal element 24 including a swellable material 26, and multiple longitudinally extending cement flow channels 22 formed on an exterior of the seal element 24.

The seal element 24 may be bonded to the tubular 12.

The well packer 20 may include at least one end ring 34 which restricts longitudinal displacement of the seal element 24 relative to the tubular 12. The multiple longitudinally extending cement flow channels 22 can be formed on an exterior of the end ring 34.

The seal element 24 may be attached to a centralizer 40 in one example.

A method of constructing a well packer 20 for use in cementing a tubular 12 in a wellbore 14 is also described above. In one example, the method can comprise: forming a seal element 24 having multiple longitudinally extending cement flow channels 22 on an exterior thereof, the seal element 24 including a swellable material 26; and positioning the seal element 24 on the tubular 12, the seal element 24 extending continuously about the tubular 12.

The seal element 24 may be attached to a centralizer 40 prior to the positioning step.

Also described above is a method of cementing a tubular 12 in a wellbore 14. In one example, the method can comprise: flowing cement 16 through an annulus 18 between the tubular string 12 and the wellbore 14, the flowing step including flowing the cement 16 through multiple longitudinally extending cement flow channels 22 on a seal element 24 which continuously encircles the tubular 12; and an activating agent (e.g., in fluid 28) swelling a swellable material 26 of the seal element 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well packer, comprising: a seal element adapted to extend continuously about a tubular, the seal element including a swellable material and having an entire longitudinal length, and multiple longitudinally extending cement flow channels formed in the swellable material on an exterior of the seal element, wherein the swellable material swells in response to contact with an activating agent, wherein the swellable material has an entire length from a first axial end and an opposed second axial end, wherein the flow channels extend axially along the entire axial length of the swellable material from the first axial end to the second axial end, the well packer further comprising at least-one end ring which restricts longitudinal displacement of the seal element relative to the tubular and has an alignment member that fits into a recess in the surface of the end ring adjacent to the seal element and into a corresponding recess in the seal element, the corresponding recess being adjacent the tubular member, so that rotational movement of the seal element relative to the tubular member is prevented, and wherein the multiple longitudinally extending cement flow channels are contiguous with corresponding flow channel portions formed on an exterior of the end ring.

2. The well packer of claim 1, wherein the seal element is bonded to the tubular.

3. The well packer of claim 1, wherein the seal element is attached to a centralizer.

4. The well packer of claim 1, wherein the first axial end of the swellable material includes a frustoconical taper towards the first end, and wherein the second axial end of the swellable material includes a frustoconical taper towards the second end, and wherein each flow channel extends through both frustoconical tapers in the swellable material.

5. The well backer of claim 4, wherein each frustoconical taper extends about one third of the entire length of the swellable material, and wherein there is a non-tapered section of the swellable material between the first and second frustoconical tapers.

6. A method of constructing a well packer for use in cementing a tubular in a wellbore, the method comprising:

forming a seal element having multiple longitudinally extending cement flow channels in a swellable material on an exterior thereof and having an entire longitudinal length;

positioning the sea element on the tubular, the seal element extending continuously about the tubular, wherein the swellable material has an entire length from a first axial end and an opposed second axial end, wherein the flow channels extend axially along the entire axial length of the swellable material from the first axial end to the second axial end;

bonding the seal element to the tubular;

positioning at least one end ring on the tubular, the end ring restricting longitudinal displacement of the seal element relative to the tubular; and fitting an alignment member into a recess in the surface of the end ring adjacent to the seal element and into a corresponding recess in the seal element, the corresponding recess being adjacent the tubular member, so that rotational movement of the sea element relative to the tubular member is prevented, and further comprising forming the multiple longitudinally extending cement flow channels on an exterior of the end ring.

7. The method of claim 6, further comprising attaching the seal element to a centralizer.

8. The method of claim 7, wherein the attaching is performed prior to the positioning.

9. A method of cementing a tubular in a wellbore, the method comprising:

flowing cement through an annulus between a tubular string and the wellbore, the flowing including flowing the cement through multiple longitudinally extending cement flow channels in a swellable material on a seal element and having an entire longitudinal length which continuously encircles the tubular wherein the swellable material has an entire length from a first axial end and an opposed second axial end, wherein the flow channels extend axially along the entire axial length of the swellable material from the first axial end to the second axial end;

using an activating agent to swell the swellable material of the seal element;

positioning at least one end ring on the tubular, the end ring restricting longitudinal displacement of the seal element relative to the tubular, fitting an alignment member into a recess in the surface of the end ring adjacent to the seal element and into a corresponding recess in the seal element, the corresponding recess being adjacent the tubular member, so that rotational movement of the seal element relative to the tubular member is prevented, and further comprising forming the multiple longitudinally extending cement flow channels on an exterior of the end ring.

10. The method of claim 9, further comprising bonding the seal element to the tubular.

11. The method of claim 9, further comprising attaching the seal element to a centralizer.

12. The method of claim 11, wherein the attaching is performed prior to positioning the seal element and the centralizer on the tubular.

* * * * *